US005759065A

United States Patent [19]

Hatagishi et al.

[11] Patent Number: 5,759,065

[45] Date of Patent: Jun. 2, 1998

[54] PRESSURE-CONTACT JOINT CONNECTOR

[75] Inventors: Yuji Hatagishi; Hiroshi Yamamoto, both of Shizuoka, Japan

[73] Assignee: Yazaki Corporation, Tokyo, Japan

[21] Appl. No.: 588,312

[22] Filed: Jan. 18, 1996

[30] Foreign Application Priority Data

Jan. 23, 1995 [JP] Japan ..... 7-008281

[51] Int. Cl.[6] ..... H01R 13/40

[52] U.S. Cl. ..... 439/596; 439/417; 439/404

[58] Field of Search ..... 439/595, 596, 439/404, 417–419

[56] References Cited

U.S. PATENT DOCUMENTS

| | | | |
|---|---|---|---|
| 4,017,141 | 4/1977 | Bury et al. | 439/596 |
| 4,475,786 | 10/1984 | Root et al. | 439/404 |
| 4,758,183 | 7/1988 | Aoyama | 439/596 |
| 4,979,913 | 12/1990 | Aiello et al. | 439/596 |
| 5,171,163 | 12/1992 | McClelland | 439/404 |
| 5,498,172 | 3/1996 | Noda | 439/404 |
| 5,562,478 | 10/1996 | Yamamoto | 439/417 |

*Primary Examiner*—J. J. Swann

*Attorney, Agent, or Firm*—Sughrue, Mion, Zinn, Macpeak & Seas, PLLC

[57] ABSTRACT

A pressure-contact joint connector for electrically interconnecting a plurality of coated wires. The joint connector includes a connector body having a terminal provided with a plurality of pressure-contact blades electrically connected to each other for electrically interconnecting the wires; a cover for covering the connector body and retaining the electric wires in the terminal, the cover including first and second locking members each on opposite sides of the cover; and a hinge for interconnecting the cover and the connector body such that the cover can be pivoted to the closed position with respect to the connector body. The connector body includes first and second locks each on opposite sides of the connector body. The first locking member of the cover is engageable with the first lock of the connector body when the cover is partially engaged with the connector body and the second locking member of the cover is engageable with the second lock of the connector body when the cover is completely engaged with the connector body. The hinge includes a strap which bends inwardly toward the interior of the connector body and the cover when the cover is pivoted from the open position to the closed position.

14 Claims, 4 Drawing Sheets

PRESSURE-CONTACT JOINT CONNECTOR

BACKGROUND OF THE INVENTION

1 Field of the Invention

The present invention relates to a pressure contact joint connector for electrically interconnecting a plurality of coated electric wires, and particularly relates to a pressure-contact joint connector in which a cover can be set to cover a connector body surely and easily.

2 Related Art

Conventionally, various pressure-contact joint connectors for pressure-contact connection of electric wires in connector bodies have been proposed. For example, a conventional pressure-contact joint connector is disclosed in JP-U-63-171971.

In such a conventional connector, as shown in FIG. 6, a pressure-contact joint connector 51 is constituted by a connector body 55 and a cover 59. The connector body 55 has a pair of electric wire mounting grooves 56 for holding two coated electric wires 52. The cover 59 is integrally provided with a terminal 54, a pair of electric wire pressing grooves 57, and a pair of electric wire pressing members 58. The terminal 54 has a pair of pressure-contact blades 53 provided on the right and left sides of the terminal 54 in the widthwise direction of the cover 59. The pressure-contact blades 53 are electrically interconnected through a metal plate to thereby electrically interconnect the electric wires 52 in such a manner as will be described below. The cover 59 is designed so that when it is positioned to cover the connection body 55, the terminal 54 is directed downwardly so that the pressure-contact blades 53, the electric wire pressing grooves 57 and the electric wire pressing members 58 press against the wires 52 mounted on the electric wire mounting grooves 56.

Further, the cover 59 is connected to one side of the connector body 55 through a pair of band-like hinges 60 having bent portions 61 at the mid-point. In addition, lock arms 62 extend downwardly from opposite lateral sides of the cover 59 and locks 63, engageable with the lock arms 62, are provided on opposite lateral sides of the connector body 55.

In the above structure, the two electric wires 52 are first mounted on the electric wire mounting grooves 56 of the connector body 55, respectively. Thereafter, the cover 59 is rotated about the bent portions 61 of the hinges 60 so that it covers the upper portion of the connector body 55. When the cover 59 is pressed from above, for example, by a jig or the like, the coating portions of the electric wires 52 are cut by the pressure-contact blades 53 of the terminal 54 respectively, so that the pressure-contact blades 53 directly and strongly contact the cores of the electric wires 52, respectively, to thereby electrically interconnect the two electric wires 52.

Further, since the two electric wires 52 are firmly pressed against the electric wire mounting grooves 56 of the connector body 55 by the electric wire pressing grooves 57 and the electric wire pressing members 58 of the cover 59, the two electric wires 52 are held firmly by the pressure-contact joint connector 51.

In such a conventional joint connector, however, the cover 59 is position over the connector body 55 from above in an oblique orientation as the cover is rotated about the bent portions 61 of the hinges 60. Therefore, the lock arms 62 of the cover 59 do not always align with the locks 63 of the connector body 55 so that the cover is not properly attached to the connector body 55.

In addition, another problem is that the hinges 60 project outwardly from one side of the connector body 55 when in the locked position creating an obstruction.

SUMMARY OF THE INVENTION

Taking the foregoing problems into consideration, an object of the present invention is to provide a pressure-contact joint connector in which a cover can be easily and accurately secured to the connector body without the hinges creating an obstruction.

In order to attain the foregoing object, according to an aspect of the present invention, the pressure-contact joint connector comprises a connector body having a terminal provided with a plurality of pressure-contact blades electrically connected to each other for connecting a plurality of coated electric wires to each other, and a cover for covering the connector body and retaining the electric wires, wherein final locks and temporary locks are provided on each of opposite sides of the cover; final lock arms to be engaged with the final locks and temporary lock arms to be engaged with the temporary locks are provided on the connector body; and the cover is coupled with the connector body through a hinge so that the hinge is bent inward and received inside the connector body when the cover is in the locked state.

Preferably, the bases of the hinge on the connector body side and on the cover side extend obliquely inward, and a bent portion of the hinge at the center thereof is thin.

Moreover, the final lock arms and the temporary lock arms are integrally formed so that one of the front and rear end portions of each of the lock arms functions as the temporary lock arm.

In the thus configured pressure-contact joint connector according to the present invention, the pressure-contact connection of the electric wires to the terminal is performed by means of a jig or the like before the cover is set to fit on the connector body. Accordingly, since only a small force is necessary to achieve the temporarily locked state, it is possible to temporarily engage the cover with the connector body in a proper position from just above the connector body, although the cover is coupled with the connector body through the hinge. Therefore, even if the cover is pressed strongly so as to completely engage with the connector body, it is possible to provide stable and accurate fitting of the cover onto the connector body. Accordingly, the reliability is improved.

In addition, since the bases of the hinge on the connector body side and on the cover side extends obliquely inward, the hinge is bent inward and received inside the connector body when the cover is set to fit on connector body. Therefore, the hinge does not create an obstruction and it is possible to prevent looseness from occurring between the cover and the connector body. In addition, the cover can be opened easily by the aid of the elastic force of the hinge, so that the connector can be more easily used.

Further the final lock arms and the temporary lock arms are formed integrally, so that the structure is simplified and the miniaturization is achieved.

DETAILED DESCRIPTION OF THE INVENTION

Figure 1:
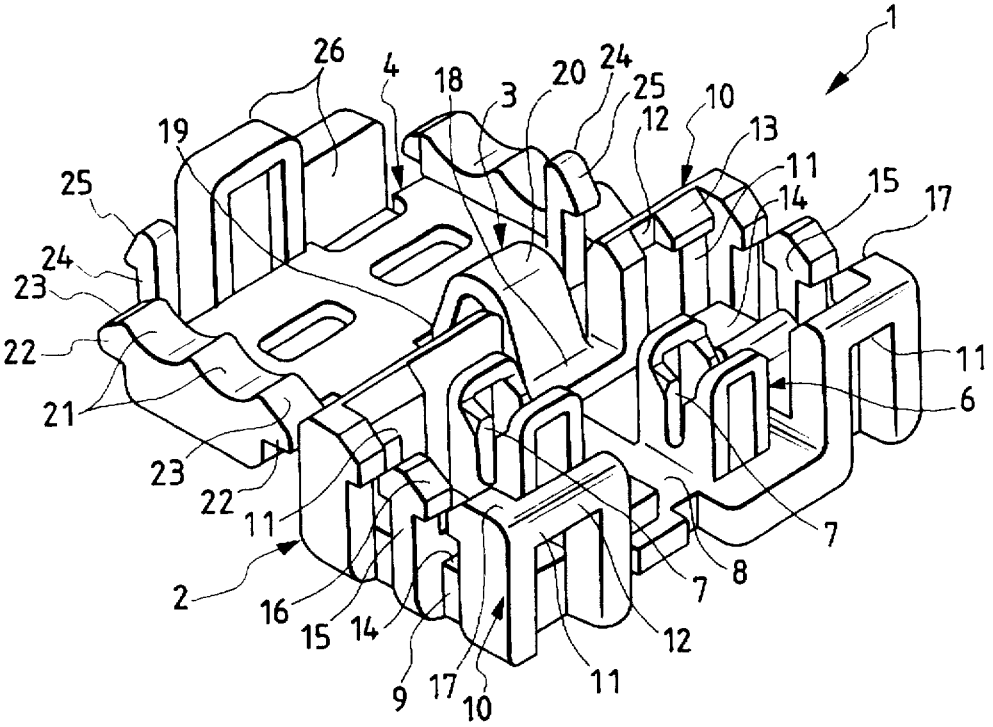
FIG. 1 is a perspective view illustrating an embodiment of the present invention.
Figure 3:
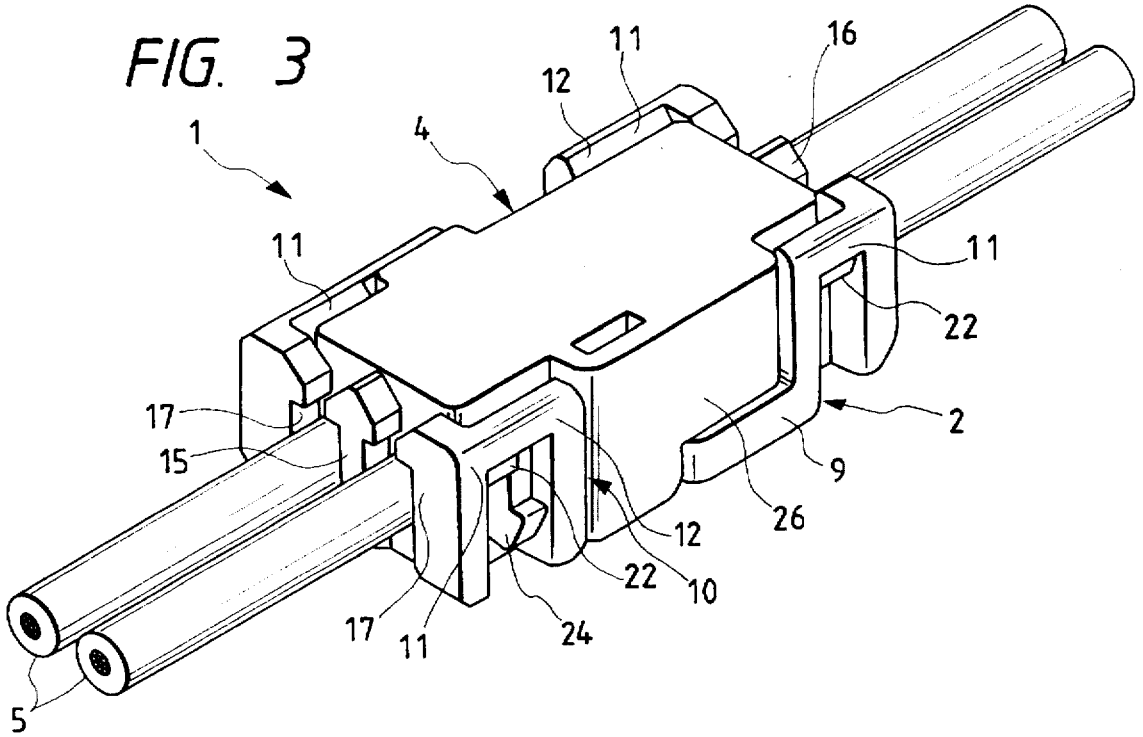
FIG. 3 is a perspective view illustrating the assembled state of the FIG. 1 embodiment.
Figure 2:
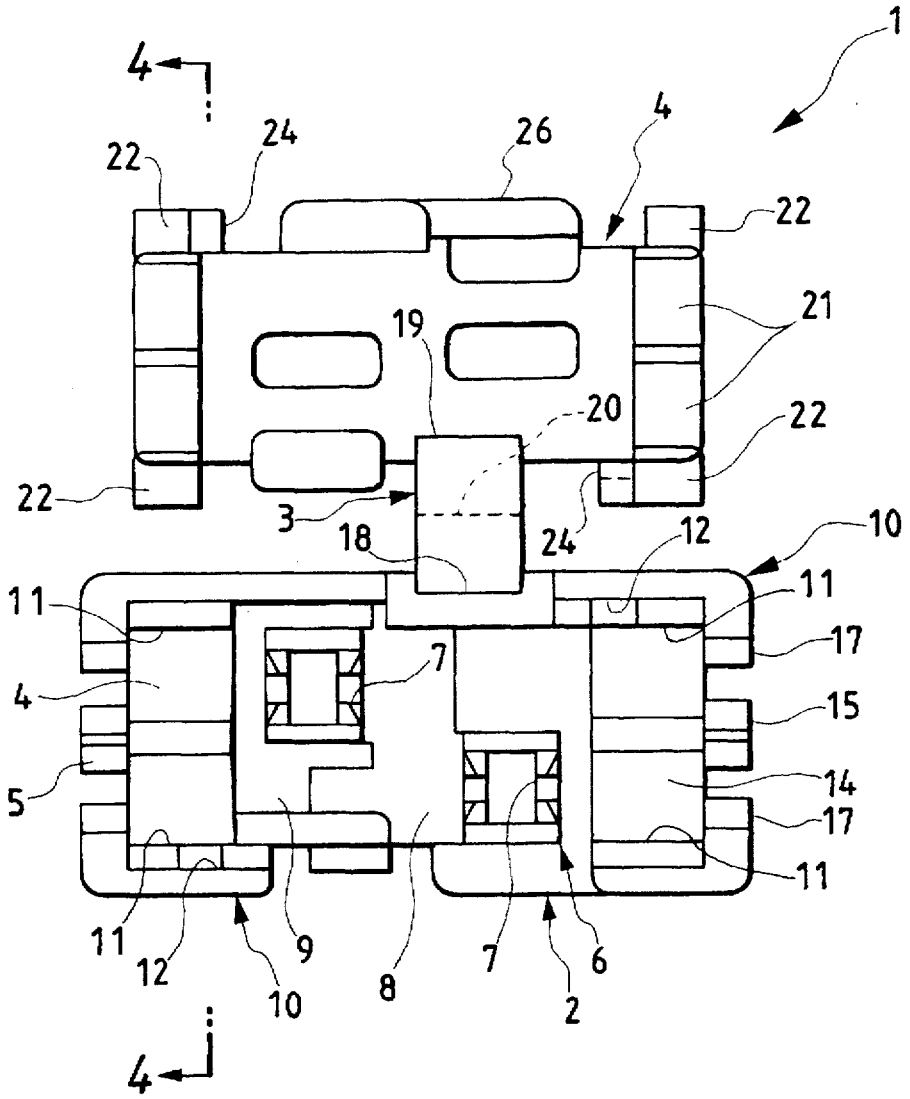
FIG. 2 is a plan view of the FIG. 1 embodiment.
Figure 4:
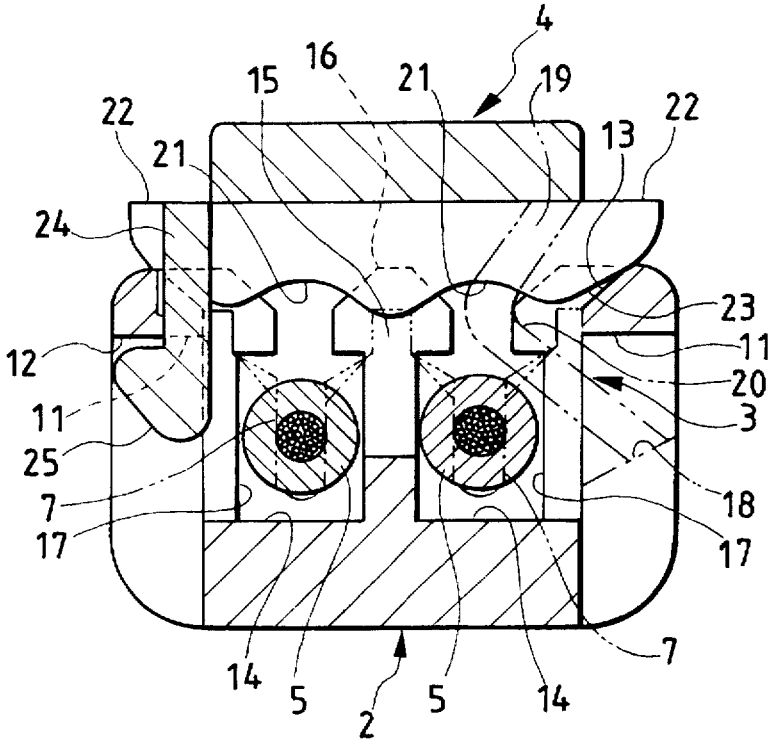
FIG. 4 is a cross-sectional view along line 4—4 in FIG. 2 illustrating the connector with the cover in the temporary locked state.
Figure 5:
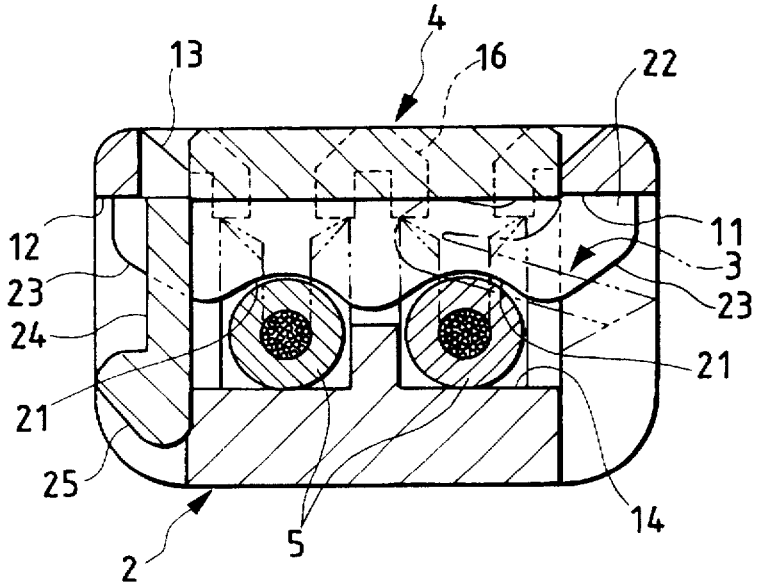
FIG. 5 is a cross-sectional view taken along line 4—4 in FIG. 2 illustrating the connector with the cover in the final locked state.
Figure 6:
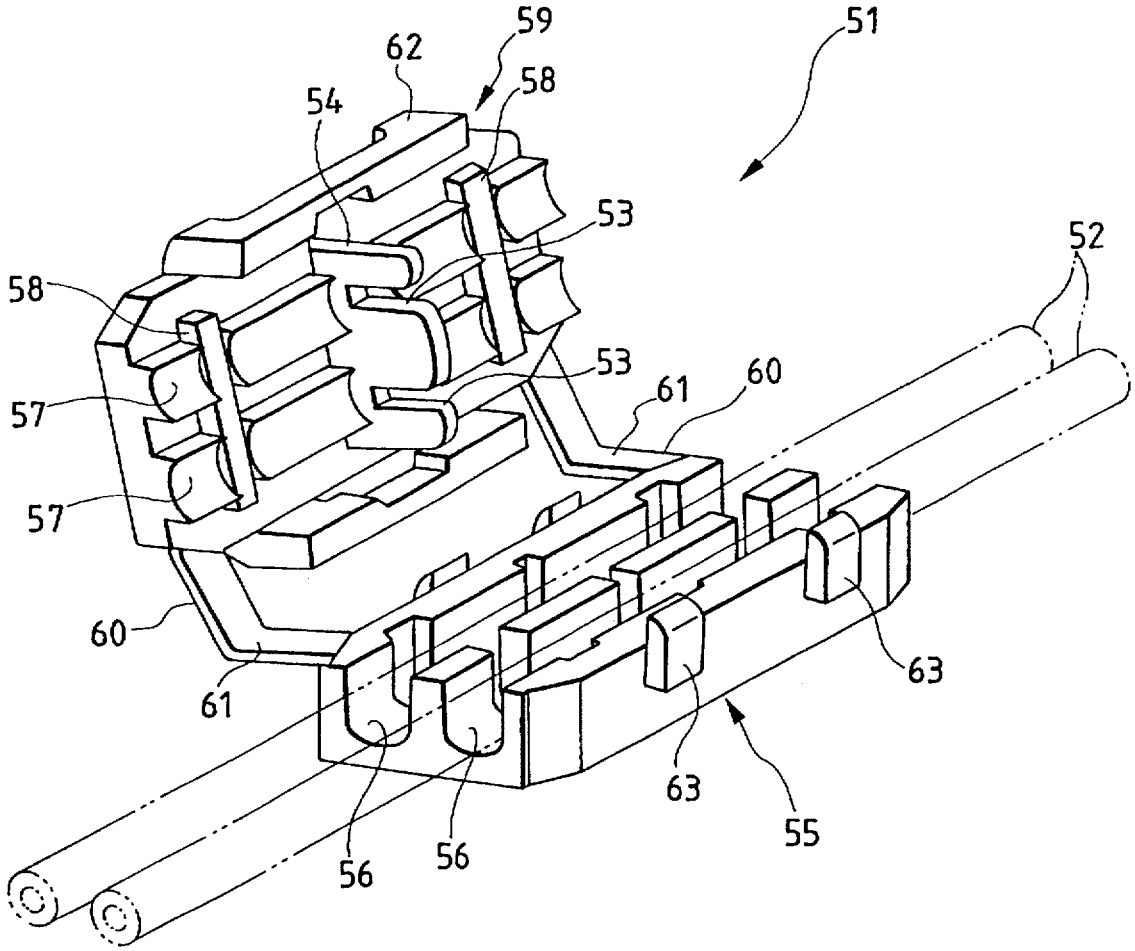
PRIOR ART FIG. 6
FIG. 6 is a perspective view illustrating a conventional pressure-contact joint connector.

An embodiment of the pressure-contact joint connector according to the present invention will be described below in detail with reference to FIGS. 1 to 5. FIG. 1 is a perspective view illustrating an embodiment of the present invention; FIG. 2 is a plan view of the FIG. 1 embodiment; FIG. 3 is a perspective view illustrating the assembled state of the FIG. 1 embodiment; FIG. 4 is a cross-sectional view along line 4—4 in FIG. 2 illustrating the connector with the cover in the temporary locked state; and FIG. 5 is a cross-sectional view taken along line 4—4 in FIG. 2 illustrating the connector with the cover in the final locked state.

As shown in FIG. 1, a pressure-contact joint connector 1 is constituted by a connector body 2, and a cover 4 connected to the connector body 2 so as to be rotatable through a hinge 3. Two coated electric wires 5 are held by this joint connector 1 so as to be electrically connected to each other. The connector body 2, the hinge 3 and the cover 4 are formed of a material having flexibility, such as synthetic resin, or the like.

More specifically, as shown in FIGS. 1 and 2, the connector body 2 has a terminal 6 cast therein. Two pressure-contact blades 7 are provided in the terminal 6, and disposed on a common metal base plate 8 such that blades are electrically interconnected via the base plate. In addition, two gate-like lock arms 10 project upwardly from a bottom plate 9. The horizontal cross-bars (in FIG. 1) of the lock arms 10 act as locking portions. Specifically, the end portions of the cross-bars form final lock portions 11, and the adjacent inside portions of the cross-bars function as temporary lock portions 12. Guide slopes 13 are provided on the upper surfaces of the final lock portions 11. As is apparent in FIG. 1, the gatelike lock arms 10 are diagonally opposed from each other with one lock arm 10 extending from one side of the front of the cover and the other lock arm 10 extending from the opposite side of the rear of the cover.

In addition, the front and rear end portions of the bottom plate 9 are thicker than the mid-portion to function as electric wire mounting members 14. Electric wire holding arms 15 extend upwardly from the front and rear end surfaces of the bottom plate 9 and include guide slopes 16 at the upper end thereof, respectively. Provided on opposite lateral sides of each of the wire holding arms 15 are electric wire holding arms 17 so as to be integral with the final lock portions 11. Corresponding guide slopes are also provided on each of the wire holding arms 17 so that the wires are properly guided by the various guide slopes.

Next, the cover 4 is coupled with the connector body 2 through the hinge 3 as shown in FIG. 4. The base 18 of the hinge 3 on the connector body 2 side and the opposing base 19 of the hinge on the cover 4 side are provided so as to extend obliquely inward, while a bent portion 20 of the center portion of the hinge 3 is formed to be thinner than the base portions.

Next, two electric pressing grooves 21 are provided in parallel to each other so as to be concave upward (downward in FIG. 1) on each of the front and rear ends of the cover 4, and their end portions are stepped to form final locks 22 having guide slopes 23 formed therein. Temporary locks 24 are provided on the rear end side of the front final lock 22 and on the front end side of the rear final lock 22, each including a lock projection which extends outwardly. Guide slopes 25 are also provided at the top ends of the temporary locks 24, respectively. Further, a side plate 26 is provided on the side surface of the cover 4 so as to project down when the cover is in the position illustrated in FIGS. 4 and 5.

In the thus configured embodiment, first, two electric wires 5 are guided by the electric wire holding arms 15 and 17 provided at the front and rear ends of the connector body 2, respectively. After being mounted on the pressure-contact blades 7 of the terminal 6, the electric wires 5 are pressed into the pressure-contact blades 7 by means of a jig, or the like.

Next, the hinge 3 is bent toward the inside of the connector body 2 so that the cover 4 covers the connector body 2 from above, as shown in FIG. 4. When the cover 4 is slightly pushed down from above as shown in FIG. 4, the temporary locks 24 are guided by their respective guide slopes 25 so as to be locked to the temporary lock portions 12 of the lock arms 10. At this time, the cover 4 is in a state in which it is temporarily locked in a predetermined position on the connector body 2.

Further, when the cover 4 is further pushed strongly by a jig, or the like, as shown in FIG. 5, the final locks 22 are guided by their respective guide slopes 13 and 23 so as to be completely locked by the complete lock portions 11 of lock arms 10. At the same time, the two electric wires 5 are pressed by the electric wire pressing grooves 21 so as to be pushed into the electric wire mounting members 14 and, simultaneously, the electric wires 5 are pushed into the slits of the pressure-contact blades 7, respectively. Thus, electric conduction between the two electric wires 5 is ensured.

In addition, since the hinge 3 is bent and received inside the connector body 2 as shown in FIG. 5, the spring force of the hinge 3 always acts upward so that the final locks 22 are pressed against the lock portions of the final lock portions 11. Therefore, looseness is prevented from occurring between the cover 4 and the connector body 2. In addition, the above-mentioned spring force functions to facilitate the release of the cover 4 when the cover 4 is unlocked from the connector body 2.

As apparent from the above description, the electric wires 5 are connected through pressure contact to the pressure-contact blades by means of a jig before the cover 4 is set to cover the connector body 2. Accordingly, it is possible to mount the cover 4 on the connector body 2 in a proper posture, and it is possible to temporarily lock the cover 4 in an accurate orientation with a small force. Together with the guide slopes, it is therefore possible to always accurately perform the next process, which is the final lock operation.

In addition, since the hinge 3 is bent inward and received inside the connector body 2, the space required for wiring is relatively small. Further, since the spring force in the direction of urging the cover 4 upward is always present, it is possible to prevent looseness from occurring between the cover 4 and the connector body 2, and to facilitate the unlocking of the cover from the body 2.

Further, since the final lock portions 11 and the temporary lock portions 12 are integrally coupled as the gatelike lock arms 10, it is possible to simplify the structure, and to realize a compact and less expensive connector.

The present invention is not limited to the abovementioned embodiments, but various modifications may be effected in those embodiments to carry out the present invention. For example, the electric wires 5 are connected, through pressure contact, to the pressure-contact blades 7 by means of a jig before the cover 4 is set to cover the connector body 2 in the above embodiment. Even if it is designed so that the electric wires 5 are connected, through pressure contact, to the pressure-contact blades 7 when the cover 4 is set to cover, the cover 4 can be temporarily locked to the connector body 2 in a proper orientation since the guide slopes are provided to facilitate the proper guidance of the cover with respect to the connector body.

As described above, in the pressure-contact joint connector according to the present invention, a temporary lock and a temporary lock arm engaging with each other are provided in a cover and a connector body respectively, and a hinge coupling the connector body with the cover is bent inward and received in the connector body. It is therefore possible to set the cover almost in parallel to the connector body when the cover is initially positioned to cover the connector body. It is therefore possible to perform temporary lock operation and final lock operation easily and accurately. Accordingly, the operation performance and the reliability can be improved.

In addition, the bases of the hinge on the connector body side and on the cover side extend obliquely inward, and a bent portion of the hinge is relatively thin. As a result the hinge is always bent inward and received in the connector body when the cover is positioned to cover the connector body. Therefore, the hinge is not obstructive, and the space required for wiring can be reduced.

Since the hinge bent toward the inside of the connector body has a spring force to push the cover upward, it is possible to prevent looseness form occurring between the cover and the connector body, and the unlocking of the cover from the connector body can be aided by the spring force.

Further, since the final lock arm and the temporary lock arm are integrated to form a lock arm, the structure can be simplified and the miniaturization and the cost reduction can be accelerated.

What is claimed is:

1. A pressure-contact joint connector, comprising:

a connector body having a terminal provided with a plurality of pressure-contact blades electrically connected to each other for electrically interconnecting a plurality of coated electric wires, said connector body including first and second locking means each on opposite sides of said connector body;

a cover for covering said connector body and retaining said electric wires in said terminal, said cover including first and second locking members each on opposite sides of said cover; and a hinge for interconnecting said cover and said connector body such that said cover can be pivoted from an open position to a closed position with respect to said connector body, wherein said first locking member is engageable with said first locking means when said cover is in said partially engaged position with respect to said connector body and said second locking member is engageable with said second locking means when said cover is in said completely engaged position with respect to said connector body, wherein said hinge includes a strap which bends inwardly toward and is received at least partially in the interior of said connector body and said cover when said cover is pivoted from said open position to said closed position.

2. The pressure-contact joint connector of claim 1, wherein said strap further comprises opposite base portions where said strap is respectively connected to said cover and said connector body, so that said base portions obliquely face inwardly, and wherein a mid-portion of said strap between said base portions is thinner than said base portions, said strap bending at said mid-portion inward of said connector body.

3. The pressure-contact joint connector of claim 1, wherein said first and second locking means includes a single arm extending from said connector body.

4. The pressure-contact joint connector of claim 3, wherein said arm is U-shaped including a pair of base members and a cross-member interconnecting said base members.

5. The pressure-contact joint connector of claim 4, wherein said cross-member is successively engaged by said first and second locking members when said cover is moved from a partially engaged position to a completely engaged position.

6. The pressure-contact joint connector of claim 1, wherein said first and second locking members are disposed immediately adjacent one another.

7. The pressure-contact joint connector of claim 1, wherein said cover includes a plurality of pressing members having grooves which abut against said wires received by said pressure-contact blades.

8. The pressure-contact joint connector of claim 7, wherein said second locking members respectively extend from said pressing members and are unitary therewith.

9. The pressure-contact joint connector of claim 1, wherein said connector body includes a bottom plate, opposite longitudinal ends of said bottom plate having a thickness which is greater than a thickness of an intermediate portion of said bottom plate, said terminal being embedded in said intermediate portion.

10. The pressure-contact joint connector of claim 9, wherein said connector body further includes a plurality holding arms extending from said longitudinal ends of said bottom plate for respectively holding said wires in wire receiving slots defined between adjacent holding arms.

11. The pressure-contact joint connector of claim 10, wherein some of said holding arms are integral to said first and second locking means.

12. The pressure-contact joint connector of claim 10, wherein said holding arms each has an inclined surface at an end thereof for guiding said wires into said wire receiving slots.

13. A pressure-contact joint connector, comprising:

a connector body having a terminal provided with a plurality of pressure-contact blades electrically connected to each other for electrically interconnecting a plurality of coated electric wires, said connector body including locking means on opposite sides of said connector body;

a cover for covering said connector body and retaining said electric wires in said terminal, said cover including locking members on opposite sides of said cover; and a hinge for interconnecting said cover and said connector body such that said cover can be pivoted from an open position to a closed position with respect to said connector body, wherein said locking members are engageable with said locking means when said cover is in a closed position and wherein said hinge bends inwardly toward and is received at least partially in the interior of said connector body and said cover when said cover is pivoted from said open position to said closed position.

14. The pressure-contact joint connector of claim 13, wherein said hinge includes a strap, a mid-portion of said strap having a thickness which is smaller than a thickness of base portions of said strap.

* * * * *